US008892018B2

(12) United States Patent
Suzuki

(10) Patent No.: US 8,892,018 B2
(45) Date of Patent: Nov. 18, 2014

(54) FIXING DEVICE

(75) Inventor: Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 725 days.

(21) Appl. No.: 13/052,638

(22) Filed: Mar. 21, 2011

(65) Prior Publication Data

US 2011/0293341 A1 Dec. 1, 2011

(30) Foreign Application Priority Data

May 27, 2010 (JP) ..... 2010-122008

(51) Int. Cl.
*G03G 15/20* (2006.01)

(52) U.S. Cl.
CPC ..... *G03G 15/2053* (2013.01); *G03G 15/2064* (2013.01)
USPC ..... 399/330; 432/60; 432/228

(58) Field of Classification Search
CPC ..... G03G 15/2053; G03G 15/2078; G03G 15/2064; G03G 2215/2032; G03G 15/2082
USPC ..... 399/330; 432/60, 228
See application file for complete search history.

(56) References Cited

U.S. PATENT DOCUMENTS

| | | | | |
|---|---|---|---|---|
| 7,266,337 | B2 | 9/2007 | Nakamura et al. | |
| 2005/0180789 | A1 | 8/2005 | Nakamura et al. | |
| 2009/0028616 | A1 * | 1/2009 | Nakamura et al. | 399/330 |

FOREIGN PATENT DOCUMENTS

| | | |
|---|---|---|
| JP | 08-106228 | 4/1996 |
| JP | 09-197871 | 7/1997 |
| JP | 10-333469 | 12/1998 |
| JP | 11-024469 | 1/1999 |
| JP | 2003-329030 | 11/2003 |
| JP | 2004-170739 | 6/2004 |

OTHER PUBLICATIONS

Office Action for corresponding Japanese Patent Application 2010-122008 dated Apr. 24, 2012.

* cited by examiner

*Primary Examiner* — Walter L Lindsay, Jr.
*Assistant Examiner* — Ruth Labombard
(74) *Attorney, Agent, or Firm* — Banner & Witcoff, Ltd.

(57) ABSTRACT

A fixing device includes a heat roller and a heater. The heat roller extends in an axial direction and includes a cylindrical-shaped roller section and a coil, the roller section having an inner peripheral surface defining an internal space therewithin and the coil being wound along the inner peripheral surface, the heat roller being configured of a plurality of zones in the axial direction, the plurality of zones including a low zone whose heat capacity is less than a predetermined value and a high zone whose heat capacity is not less than the predetermined value. The heater is disposed within the internal space of the roller section and has a heating wire configured to generate heat, the heating wire having at least a first portion which is in confrontation with the high zone and a second portion which is in confrontation with the low zone, and the heating wire being configured such that the first portion has an amount of heat generation greater than an amount of heat generation at the second portion.

10 Claims, 4 Drawing Sheets

FIXING DEVICE

CROSS REFERENCE TO RELATED APPLICATION

This application claims priority from Japanese Patent Application No. 2010-122008 filed May 27, 2010. The entire content of the priority application is hereby incorporated by reference in its entirety.

TECHNICAL FIELD

The present invention relates to a fixing device provided with a heat roller within which a coil for reinforcing the heat roller is provided.

BACKGROUND

A conventional fixing device includes a heat roller and a heater. The heat roller is configured of a roller section having a thin-walled cylindrical shape and a coil wound along an inner circumferential surface of the cylindrical roller section. The thin-walled roller section results in a smaller heat capacity, thereby enabling the roller section to be heated promptly. Within the thin-walled roller section, the coil is wound more densely at an intermediate portion than at both end portions in order to reinforce the intermediate portion which tends to be weak in terms of strength.

SUMMARY

However, as in the above-described fixing device, when the coil is wound to have different winding pitches in its axial direction, resultant heat capacities could greatly differ between the densely-wound intermediate portion and the coarsely-wound end portions. When the difference in heat capacity is substantial, the heater cannot heat the heat roller properly and a toner image on a sheet may be prevented from being reliably thermally fixed thereon.

In view of the foregoing, it is an object to the present invention to provide a fixing device in which a heat roller reinforced by a coil can be heated appropriately.

In order to achieve the above and other objects, the present invention provides a fixing device includes a heat roller and a heater. The heat roller extends in an axial direction and includes a cylindrical-shaped roller section and a coil, the roller section having an inner peripheral surface defining an internal space therewithin and the coil being wound along the inner peripheral surface, the heat roller being configured of a plurality of zones in the axial direction, the plurality of zones including a low zone whose heat capacity is less than a predetermined value and a high zone whose heat capacity is not less than the predetermined value. The heater is disposed within the internal space of the roller section and has a heating wire configured to generate heat, the heating wire having at least a first portion which is in confrontation with the high zone and a second portion which is in confrontation with the low zone, and the heating wire being configured such that the first portion has an amount of heat generation greater than an amount of heat generation at the second portion.

DETAILED DESCRIPTION

A general configuration of a laser printer 1 incorporating a fixing device 18 provided with a heat roller 60 according to an embodiment of the present invention will be described while referring to FIG. 1.

The terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1. Specifically, in FIG. 1, a right side will be referred to as a front side (near side), while a left side will be referred to as a rear side (far side). A near side in FIG. 1 with respect to a paper width will be referred to as a left side, while a far side in FIG. 1 will be referred to as a right side. Also, a top-to-bottom direction in FIG. 1 will be referred to as a vertical direction.

Figure 1:
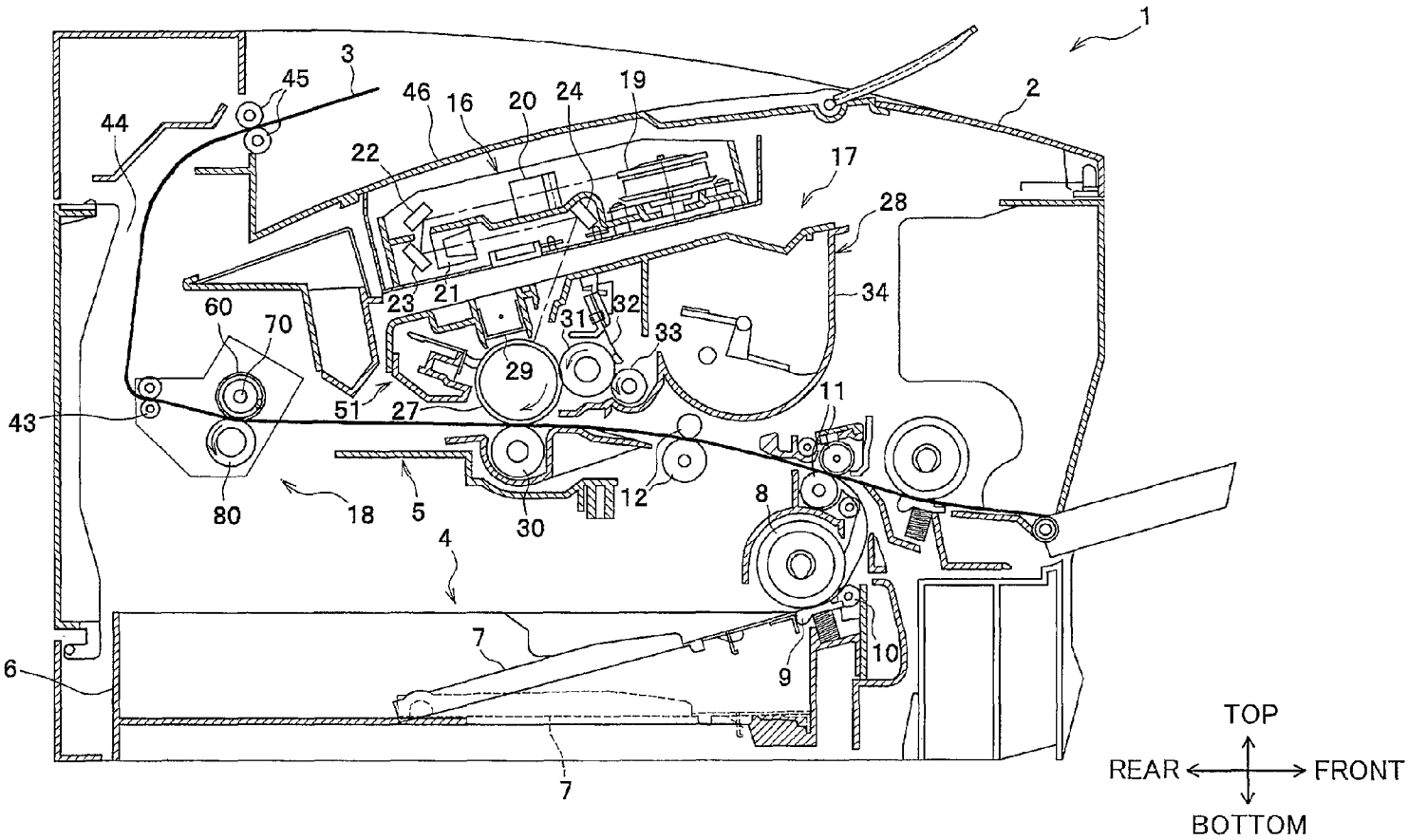
FIG. 1 is a cross-sectional view of a laser printer incorporating a fixing device provided with a heat roller according to an embodiment of the present invention.

As shown in FIG. 1, the laser printer 1 includes a main casing 2 within which a feeder unit 4 and an image forming unit 5 are disposed.

The feeder unit 4 functions to feed sheets 3 to the image forming unit 5. The feeder unit 4 includes a sheet tray 6, a lifter plate 7, a feed roller 8, a feed pad 9, paper-dust removing rollers 10, 11, and a pair of registration rollers 12. The sheet tray 6 accommodates therein the sheets 3 and is detachably mountable in a lower portion of the main casing 2. The lifter plate 7 is disposed within the sheet tray 6 for lifting the sheet 3 upward to convey the same between the feed roller 8 and the feed pad 9. The feed roller 8 and the feed pad 9 are disposed at a position above a front side end of the sheet tray 6 and convey each sheet 3 to the image forming unit 5 via the paper-dust removing rollers 10, 11 and the pair of registration rollers 12.

The image forming unit 5 includes a scan unit 16, a process cartridge 17 and the fixing device 18.

The scan unit 16 is disposed at an upper portion of the main casing 2. The scan unit 16 includes a laser emitting section (not shown), a polygon mirror 19, lenses 20, 21 and reflection mirrors 22, 23, 24. A laser beam emitted from the laser emitting section is irradiated onto a surface of a photosensitive drum 27 (to be described next) in the process cartridge 17 at a high speed, as shown by a single dot chain line in FIG. 1.

The process cartridge 17 is disposed below the scan unit 16 and is detachably mountable in the main casing 2. The process cartridge 17 includes a developing cartridge 28 and a drum unit 51.

The developing cartridge 28 includes a developing roller 31, a thickness-regulation blade 32, a supply roller 33 and a toner hopper 34 that stores toner therein. The toner stored in the toner hopper 34 is agitated by an agitator (shown without a reference numeral), and then supplied to the developing roller 31 via the supply roller 33. At this time, the toner is positively charged between the developing roller 31 and the supply roller 33. The toner supplied onto the developing roller 31 then enters between the developing roller 31 and the thickness-regulation blade 32 in accordance with rotation of the developing roller 31, and is carried on the developing roller 31 as a thin layer of uniform thickness.

The drum unit 51 includes the photosensitive drum 27, a charger 29, and a transfer roller 30. After uniformly positively charged by the charger 29, the surface of the photosensitive drum 27 is exposed to light by the high speed scanning of the laser beam from the scan unit 16. In this way, exposed areas have a lower potential, thereby forming an electrostatic latent image based on image data. As the developing roller 31 rotates and comes into contact with the photosensitive drum 27, the toner borne on the developing roller 31 is supplied to the electrostatic latent image formed on the surface of the photosensitive drum 27. The electrostatic latent image on the surface of the photosensitive drum 27 is thus developed into a visible toner image according to a reverse development process.

Subsequently, while the sheet 3 passes between the photosensitive drum 27 and the transfer roller 30, the sheet 3 is nipped therebetween so that the toner image carried on the surface of the photosensitive drum 27 is transferred onto the sheet 3. The sheet 3 on which the toner image has been transferred is then conveyed to the fixing device 18.

The fixing device 18 includes the heat roller 60, a halogen heater 70 and a pressure roller 80. The heat roller 60 has a hollow cylindrical shape, and the halogen heater 70 is disposed within an internal space of the heat roller 60. The pressure roller 80 is resiliently(elastically) deformable so as to provide a nip region between the pressure roller 80 and an outer circumferential surface of the heat roller 60. Detailed configurations of the heat roller 60 and the 70 will be described later.

In the fixing device 18, the heat roller 60 is heated due to heat from the halogen heater 70. As the sheet 3 passes between the heat roller 60 and the pressure roller 80 (the nip region), the toner image transferred on the sheet 3 is thermally fixed thereto. The paper 3 is then conveyed along a discharge path 44 first by a pair of conveyer rollers 43, and then by a pair of discharge rollers 45 to be discharged onto a discharge tray 46.

Next, detailed configurations of the heat roller 60 and the halogen heater 70 will be described with reference to FIG. 2.

Figure 2:
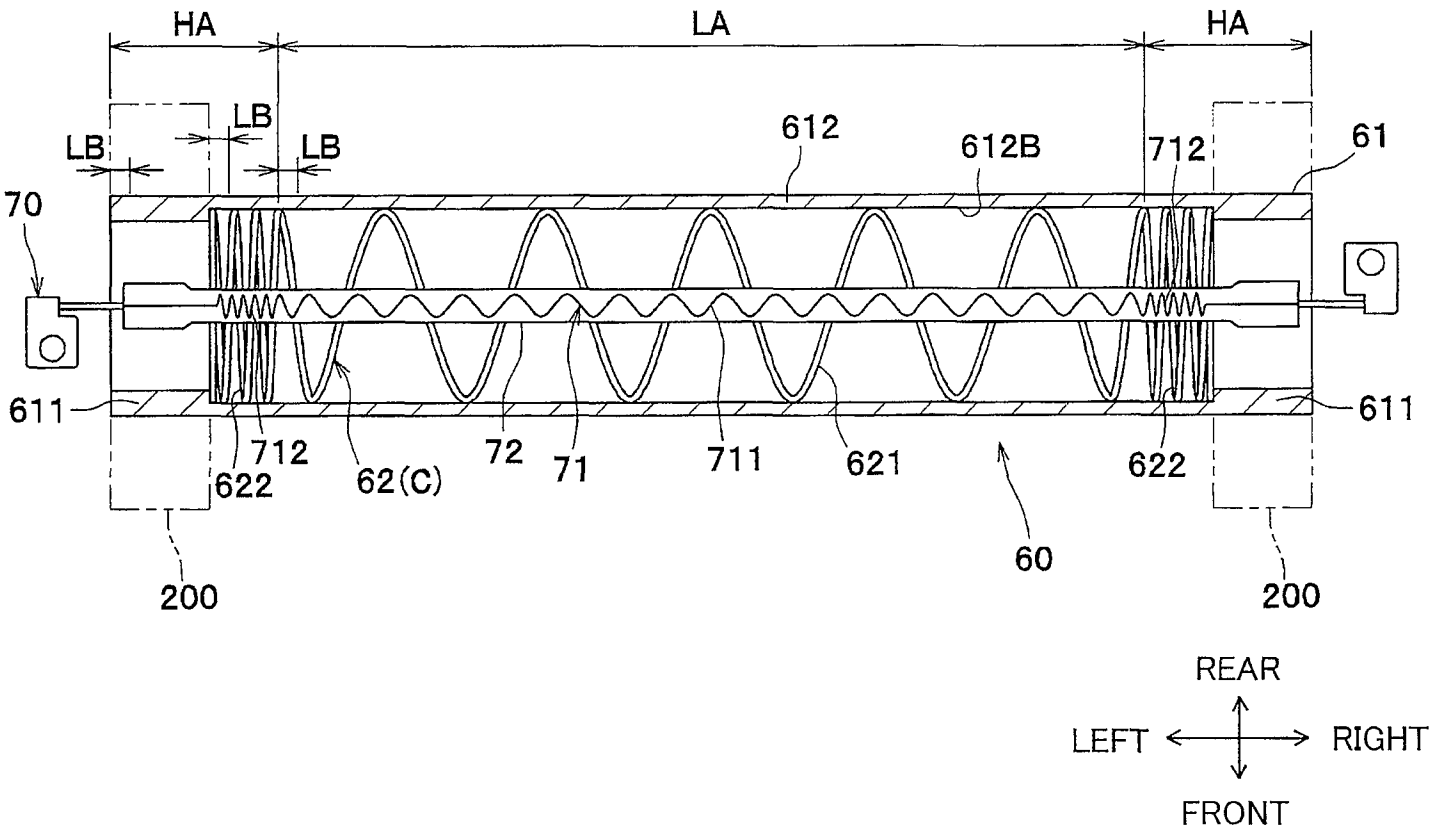
FIG. 2 is an explanatory view illustrating how a coil and a heating wire are disposed in the heat roller according to the embodiment.

As shown in FIG. 2, the heat roller 60 includes a roller section 61 and a spirally-wound coil 62. The roller section 61 has a hollow cylindrical shape and defines an inner space therewithin. The roller section 61 extends in an axial direction which is in coincidence with a left-to-right direction of the laser printer 1. The coil 62 is coaxially disposed within the inner space of the roller section 61.

The roller section 61 includes a main body region 612 and both end regions 611. The main body region 612 spans across the end regions 611 in the axial direction and serves to heat the sheet 3 passing the nip region. Each end region 611 is supported to a bearing member 200 (indicated by broken lines in FIG. 2) which is made of a resin such that each end region 611 is rotatable relative to a frame (not shown) of the fixing device 18. As shown in FIG. 2, the main body region 612 is formed to have a thickness smaller than that of the end regions 611 in a radial direction of the main body region 612. Therefore, the thin-walled main body region 612 can be promptly heated by the halogen heater 70 disposed within the internal space of the roller section 61. Further, due to the thickness greater than that of the main body region 612, the end regions 611 constitute a high heat-capacity zone HA that is defined as a portion of the heat roller 60 having a heat capacity greater than or equal to a predetermined value. Precisely, here, a heat capacity is defined as a heat capacity per unit length LB, as shown in FIG. 2.

The main body region 612 has an inner circumferential surface 612B along which the coil 62 is wound in a spiral manner for reinforcing the thin-walled main body region 612 of the roller section 61, as shown in FIG. 2. The coil 62 may be fixed to the inner circumferential surface 612B by an adhesive agent or may be engaged with the inner circumferential surface 612B by well-known mechanical means.

The coil 62 is fabricated from a single coil member C (made of a metal) that is wound in a spiral manner to have a plurality of turns (loops). More specifically, the coil 62 includes an intermediate portion 621 and both axial end portions 622 in the axial direction. The coil 62 is wound more densely (with a narrow winding pitch) at the both axial end portions 622 than at the intermediate portion 621 (with a wide winding pitch). The main body region 612 of the roller section 61 has both widthwise end areas (portions adjacent to each end region 611) that are respectively in contact with the densely-wound axial end portions 622 of the coil 62. That is, as shown in FIG. 2, the widthwise end areas of the main body region 612 are in coincidence with the axial end portions 622 of the coil 62 in the axial direction. Each widthwise end area of the main body region 612 constitutes each high heat-capacity zone HA together with each axial end portion 622 of the coil 62. In other words, each high heat-capacity zone HA is configured of: one of the thick-walled end regions 611 of the roller section 61; one of the widthwise end areas of the main body region 612 of the roller section 61; and one of the axial end portions 622 of the coil 62.

On the other hand, the main body region 612 has an intermediate area which is in contact with the coarsely-wound intermediate portion 621 of the coil 62. The intermediate area of the main body region 612 is in coincidence with the intermediate portion 621 of the coil 62 in the axial direction and constitutes a low heat-capacity zone LA together with the intermediate portion 621 of the coil 62. The low heat-capacity zone LA is defined as a portion of the heat roller 60 having a heat capacity smaller than the predetermined value.

As described above, the heat roller 60 has a plurality of regions in the axial direction each region having a heat capacity different from that of neighboring portions in the axial direction, depending on the thickness of the roller section 61 and the winding pitch of the coil 62.

Figure 3:
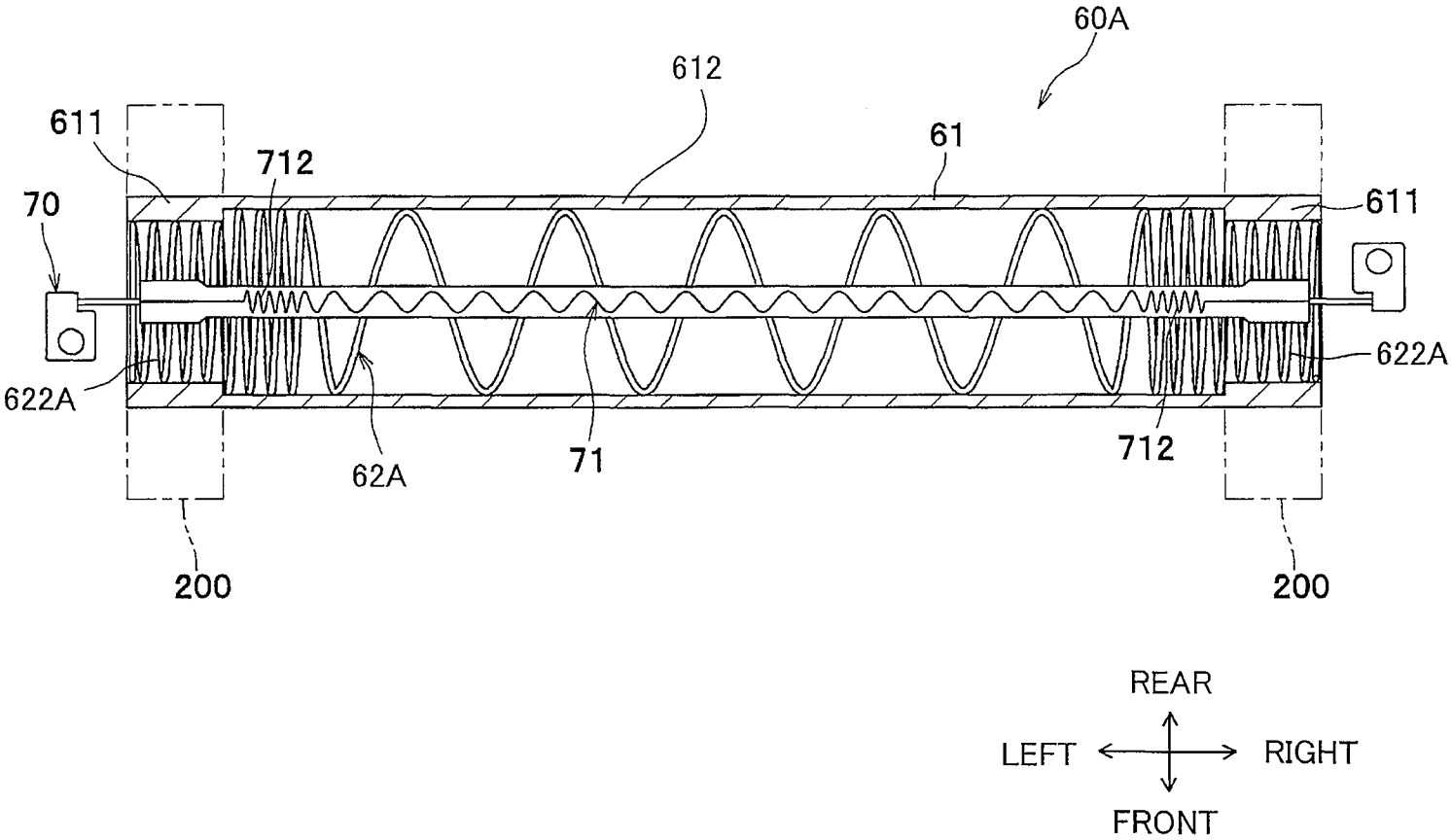
FIG. 3 is an explanatory view illustrating how a coil and a heating wire are disposed in a heat roller according to a first modification of the embodiment.
Figure 4:
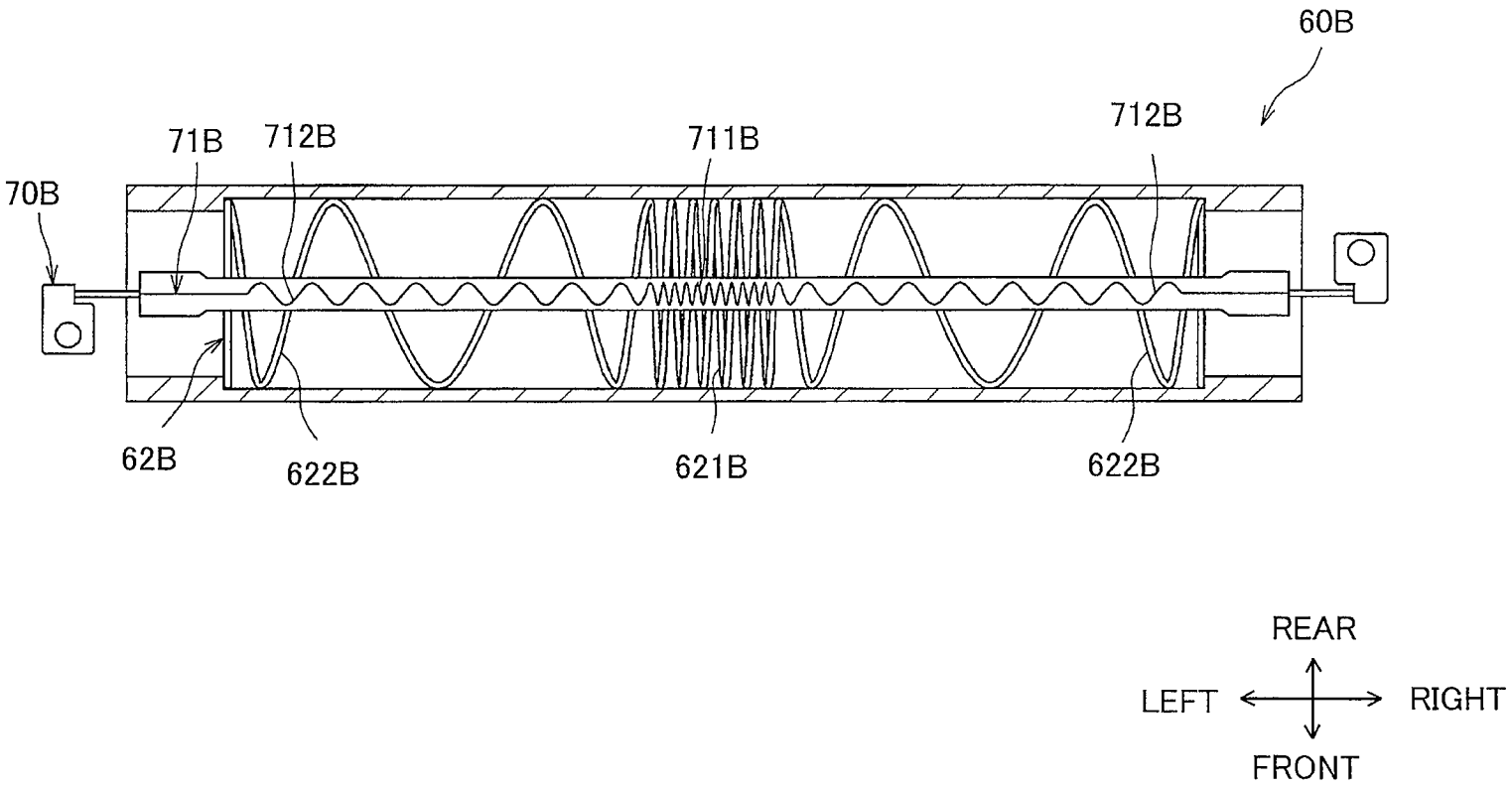
FIG. 4 is an explanatory view illustrating how a coil and a heating wire are disposed in a heat roller according to a second modification of the embodiment.

The halogen heater 70 is disposed within the internal space of the roller section 61, more specifically, within an internal space formed by the spirally-wound coil 62. The halogen heater 70 includes a heating wire 71 and a glass tube 72 that accommodates therein the heating wire 71. In FIGS. 2 through 4, for facilitating understanding, the halogen heater 70 is illustrated as if it is disposed outside of the coil 62, although the halogen heater 70 is actually disposed within the coil 62.

The heating wire 71 extends in the axial direction and is configured to generate heat when power is supplied. The heating wire 71 includes an intermediate section 711 and axial end sections 712. The intermediate section 711 opposes the low heat-capacity zone LA of the heat roller 60 in the radial direction, and each axial end section 712 opposes each high heat-capacity zone HA of the heat roller 60 in the radial direction. The heating wire 71 is wound densely at the axial end sections 712, while coarsely at the intermediate section 711, so that the axial end sections 712 can produce an amount of heat generation greater than that of the intermediate section 711.

As described above, the heating wire 71 is configured such that, the axial end sections 712, each of which is in confrontation with each high heat-capacity zone HA, can have an amount of heat generation greater than that of the intermediate section 711 which is in confrontation with the low heat-capacity zone LA. Therefore, regardless of how different the heat capacity of each zone is in the heat roller 60, the heat roller 60 can be heated appropriately in accordance with the heat capacity of each zone.

Further, since the coil 62 is wound more densely at the axial end portions 622 than the intermediate portion 621, axial end portions of the heat roller 60 (i.e., the high heat-capacity zones HA) are allowed to have a heat capacity greater than that of an intermediate portion of the heat roller 60 (i.e., the intermediate area of the main body region 612 constituting the heat-capacity zone LA). As a result, the axial end portions of the heat roller 60 can be prevented from being heated too much, and therefore meltdown of the bearing members 200 made of a resin can be suppressed. Further, the axial end portions of the heat roller 60, which has a greater heat capacity, can be efficiently heated by the densely-wound axial end sections 712 of the heating wire 71.

Further, since the end regions 611 of the roller section 61 are formed to have a thickness greater than that of the main body region 612 of the roller section 61, rigidity of the end regions 611 can be enhanced to be reliably supported to the bearing members 200. Further, the thick-walled configuration of the end regions 611 realizes an increased heat capacity. The end regions 611 can therefore be prevented from being heated too much, which contributes to suppression of meltdown of the bearing members 200 made of a resin.

Various modifications are conceivable. Hereinafter, modifications will be described with reference to accompanying drawings in which like parts and components are designated with the same reference numerals as those of the embodiment to avoid duplicating explanation FIG. 3 shows a heat roller 60A according to a first modification of the embodiment.

In the first modification, a coil 62A is wound in a spiral manner such that, axial end portions 622A of the coil 62A are densely wound as in the embodiment and extend to the thick-walled end regions 611 of the roller section 61 so as to be in contact with the same. In other words, when the coil 62A is projected in the radial direction of the roller section 61, each axial end portion 622A of the coil 62A is superposed with each bearing member 200 in the radial direction, in addition to the widthwise end areas of the thin-walled main body region 612 of the roller section 61.

With this configuration, the axial end portions 622A of the coil 62A can further enhance rigidity of the end regions 611 of the roller section 61 so that the bearing members 200 can reliably support the end regions 611. Further, axial end portions of the heat roller 60A are allowed to have a further increased heat capacity, in comparison with the heat capacity of the axial end portions of the heat roller 60 of the embodiment. Therefore, meltdown of the bearing members 200 can be further suppressed.

FIG. 4 shows a heat roller 60B according to a second modification of the embodiment. In FIG. 4, the bearing members 200 are not shown.

In the embodiment, the coil 62 is wound such that the axial end portion 622 has a winding pitch smaller than that of the intermediate portion 621, and the heating wire 71 is also wound such that the axial end section 712 is has a winding pitch smaller than that of the intermediate section 711. In contrast, a coil 62B of the second modification is wound such that its intermediate portion 621B has a winding pitch smaller than that of axial end portions 622B, and a heating wire 71B of the second modification is wound such that its intermediate section 711B has a winding pitch smaller than that of axial end portions 712B. Even with this configuration of the second modification, the intermediate portion 621B having an increased heat capacity due to the densely-wound coil 62B can be efficiently heated by the densely-wound intermediate portion 711B of the heating wire 71B that can generate an increased amount of heat.

How to wind a coil and a heating wire is not limited to the configurations shown in FIGS. 2 through 4. For example, a coil may be wound such that its densely-wound portion is provided at a portion other than intermediate and axial end portions. That is, a coil may be wound with a small winding pitch such that the densely-wound portion of the coil is positioned to be in contact with a portion of the thin-walled roller section 61 that needs to be reinforced especially. Since the densely-wound portion of the coil has an increased heat capacity, a heating wire is wound with a small winding pitch such that the densely-wound portion of the heating coil is superposed with the densely-wound portion of the coil in the radial direction of the heat roller.

While the present invention has been described with respect to specific embodiment, it will be appreciated by one skilled in the art that a variety of changes may be made without departing from the scope of the invention.

For example, instead of the heating wire 71 of the embodiment that is wound in a spiral manner, a heating wire may be folded in a zig-zag manner. In this case, in order to increase an amount of heat generation, a portion of the heating wire, which confronts a high heat-capacity zone of a heat roller, may be folded with a smaller folding angle (i.e., the portion is folded densely).

Further, although the roller section 61 of the embodiment is formed such that the end regions 611 has a thickness greater than that of the main body region 612, the roller section 61 may instead be formed to have a uniform thickness with respect to the axial direction. In this case, each end region 611 of the uniformly thin-walled roller section 61 may be backed up by a reinforcing member from inside to enhance rigidity of the end regions 611. Alternatively, the coil member C may be wound densely (or at least one turn of the coil member C may be positioned) at the end regions 611 so that both end portions of the coil member C in the axial direction can serve to support the end regions 611 of the roller section 61.

Further, the fixing device 18 according to the present invention is applied to the laser printer 1, but may also be applicable to other types of image forming devices, such as a copying machine, and a multifunction device.

Further, instead of the halogen heater 70, an IH (induction heating) heater or a heating resistance element may also be available.

Further, the sheet 3 can be an OHP sheet, instead of a plain paper and a postcard.

What is claimed is:

1. A fixing device comprising:

a heat roller extending in an axial direction and including:

a cylindrical-shaped roller section; and a coil, the roller section having an inner peripheral surface defining an internal space therewithin, the coil being wound along the inner peripheral surface, the heat roller being configured of a plurality of zones in the axial direction, the plurality of zones including a low zone whose heat capacity is less than a predetermined value and a high zone whose heat capacity is not less than the predetermined value; and a heater extending through the internal space of the roller section and having a heating wire configured to generate heat, the heating wire having at least a first portion which faces the high zone and a second portion which faces the low zone, and the heating wire being configured such that the first portion has an amount of heat generation greater than an amount of heat generation at the second portion, wherein the roller section has a thickness in a radial direction perpendicular to the axial direction, and the heat capacity of each of the plurality of zones is determined based on a winding pitch of the coil and the thickness of the roller section, wherein the coil and the heating wire respectively have an intermediate portion and axial end portions in the axial direction, wherein the coil is wound such that the axial end portions of the coil have a winding pitch smaller than that of the intermediate portion of the coil, the high zone including the axial end portions of the coil and the low zone including the intermediate portion of the coil, and wherein the heating wire are wound such that the axial end portions of the heating wire have a winding pitch smaller than that of the intermediate portion of the heating wire, the axial end portions of the heating wire forming the first portion and the intermediate portion of the heating wire forming the second portion.

2. The fixing device according to claim 1, wherein the roller section has axial end regions and an intermediate region in the axial direction, the intermediate region of the roller section being disposed between the axial end regions in the axial direction, the axial end regions having a thickness greater than that of the intermediate region in the radial direction perpendicular to the axial direction, the high zone including the axial end regions and the low zone including the intermediate region.

3. The fixing device according to claim 2, further comprising a pair of bearing members configured to rotatably support the axial end regions of the roller section.

4. The fixing device according to claim 3, wherein the coil is disposed so as to be superposed with each bearing member in the radial direction when the coil is projected in the radial direction.

5. The fixing device according to claim 1, wherein the heater includes a halogen heater.

6. A fixing device comprising:

a heat roller extending in an axial direction and including:

a cylindrical-shaped roller section; and a coil, the roller section having an inner peripheral surface defining an internal space therewithin, the coil being wound along the inner peripheral surface, the heat roller being configured of a plurality of zones in the axial direction, the plurality of zones including a low zone whose heat capacity is less than a predetermined value and a high zone whose heat capacity is not less than the predetermined value; and a heater extending through the internal space of the roller section and having a heating wire configured to generate heat, the heating wire having at least a first portion which faces the high zone and a second portion which faces the low zone, and the heating wire being configured such that the first portion has an amount of heat generation greater than an amount of heat generation at the second portion, wherein the roller section has a thickness in a radial direction perpendicular to the axial direction, and the heat capacity of each of the plurality of zones is determined based on a winding pitch of the coil and the thickness of the roller section, wherein the coil and the heating wire respectively have an intermediate portion and axial end portions in the axial direction, wherein the coil is wound such that the intermediate portion of the coil has a winding pitch smaller than that of the axial end portions of the coil, the high zone including the intermediate portion of the coil and the low zone including the axial end portions of the coil, and wherein the heating wire are wound such that the intermediate portion of the heating wire has a winding pitch smaller than that of the axial end portions of the heating wire, the intermediate portion of the heating wire forming the first portion and the axial end portions of the heating wire forming the second portion.

7. The fixing device according to claim 6, wherein the heater includes a halogen heater.

8. The fixing device according to claim 6, wherein the roller section has axial end regions and an intermediate region in the axial direction, the intermediate region of the roller section being disposed between the axial end regions in the axial direction, the axial end regions having a thickness greater than that of the intermediate region in the radial direction perpendicular to the axial direction, the high zone including the axial end regions and the low zone including the intermediate region.

9. The fixing device according to claim 8, further comprising a pair of bearing members configured to rotatably support the axial end regions of the roller section.

10. The fixing device according to claim 9, wherein the coil is disposed so as to be superposed with each bearing member in the radial direction when the coil is projected in the radial direction.

* * * * *